US005803984A

United States Patent [19]

Lordo et al.

[11] Patent Number: 5,803,984

[45] Date of Patent: Sep. 8, 1998

[54] METHOD AND APPARATUS FOR RINSING STEEL PRODUCT

[75] Inventors: Richard Lordo, West Middlesex, Pa.; John J. White, Warren; Walter C. Grischow, Austintown, both of Ohio

[73] Assignee: Danieli Wean, A Division of Danieli Corporation, Youngstown, Ohio

[21] Appl. No.: 599,089

[22] Filed: Feb. 9, 1996

[51] Int. Cl.[6] ..... B08B 1/02; B08B 3/02

[52] U.S. Cl. ..... 134/18; 134/15; 134/32; 134/34; 134/57 R; 134/113

[58] Field of Search ..... 134/15, 18, 32, 134/34, 56 R, 57 R, 58 R, 113; 422/62, 106, 108, 105; 436/55

[56] References Cited

U.S. PATENT DOCUMENTS

| | | | |
|---|---|---|---|
| 2,649,099 | 8/1953 | Huff | 134/64 |
| 3,048,182 | 8/1962 | Ruthner | 134/63 |
| 3,543,775 | 12/1970 | Bodnar | 134/64 |
| 3,896,828 | 7/1975 | Foster et al. | 134/57 R |
| 3,938,214 | 2/1976 | Hodsden et al. | 15/102 |
| 4,039,349 | 8/1977 | Kwasnoski et al. | 134/10 |
| 4,119,109 | 10/1978 | Lukac et al. | 134/64 R |
| 4,325,746 | 4/1982 | Popplewell et al. | 134/10 |
| 4,417,720 | 11/1983 | Paulus | 266/112 |
| 4,726,388 | 2/1988 | Swinehart et al. | 134/45 |
| 4,788,786 | 12/1988 | Suter | 134/56 R |
| 5,179,967 | 1/1993 | Mattiussi | 134/60 |

*Primary Examiner*—Zeinab El-Arini
*Attorney, Agent, or Firm*—Armstrong, Westerman, Hattori, McLeland & Naughton

[57] ABSTRACT

A system and method for rinsing residue from steel product with a fluid includes a monitoring system for monitoring movement of the steel product and a rinse control system for controlling a pumping system to pump fluid to at least one sprayer and an actuator which can open and close a drain seal in a drain in the rinse tank. The system operates by having the monitoring system monitor the movement of the steel product through the rinse tank and generating a run signal when the steel product is moving and a stop signal when the steel product has stopped moving and the rinse control system controlling the pumping system to pump fluid to at least one sprayer in the rinse tank and the actuator to open the drain seal in the drain in the rinse tank when the run signal is received and to control the actuator to close the drain seal when the stop signal is received.

18 Claims, 3 Drawing Sheets

METHOD AND APPARATUS FOR RINSING STEEL PRODUCT

FIELD OF THE INVENTION

This invention relates generally to a method and apparatus for removing residue from a steel product and, more particularly, to a method and apparatus with a rinse control system which optimizes the use of spray and tank type systems to remove pickling acid from steel product in response to movement of the steel product and to omit staining of product upon line stoppage.

BACKGROUND OF THE INVENTION

Pickling is a chemical treatment in the manufacture of steel strip which involves the application of acid to the steel strip to dissolve surface contaminants, such as oxide scale. Once the surface contaminants are dissolved, the pickling acid must be removed from the steel strip to prevent corrosive damage. Accordingly, systems for removing the pickling acid on the steel strip have been developed, but as explained below each of these prior systems has problems with either cleaning and/or staining of the final product.

One system for removing the pickling acid is to immerse the steel strip in each of a series of tanks filled with water to wash the acid off. An example of this type of system is disclosed in U.S. Pat. No. 5,179,967 to Mattiussi, which is herein incorporated by reference. For this technique to work, the metal strip must pass through each tank at a certain minimum speed to generate enough agitation in each tank to wash off the acid. If the speed of the passing steel strip is too slow, then acid will remain and damage the steel strip.

Another system for removing the pickling acid is to spray the steel strip with water to remove the acid. An example of this type of system is disclosed in U.S. Pat. No. 3,938,214 to Hodsden et al. which is herein incorporated by reference. The spraying system is generally preferred over the tank system because the effectiveness of the spray system does not depend upon the speed of travel of the steel strip through the system. With a spray type system, the acid will be removed from the metal strip even during slow speeds for passing the steel strip past the sprayers. However, if the steel product stops moving in the spray type of system, oxidation will occur over the body of the steel strip and at the point of impact of the water sprays with the steel strip, forming a brown stain which is unacceptable to final users.

SUMMARY OF INVENTION

A system and method for rinsing residue from steel product with a fluid in accordance with the present invention includes a monitoring system for monitoring movement of the steel product and a rinse control system for controlling a pumping system connected to at least one sprayer and an actuator which can open and close a drain seal in a drain in the rinse tank. The system operates by having the monitoring system monitor the movement of the steel product through the rinse tank and generating a run signal when the steel product is moving and a stop signal when the steel product has stopped moving and the rinse control system controlling the pumping system to pump fluid to the sprayer and the actuator to open the drain seal in the drain in the rinse tank when the run signal is received and to control the actuator to close the drain seal when the stop signal is received. The system and method will include a flooding pipe and a delay system. With the flood piping, the rinse control system controls the pumping system to pump fluid into the flood piping in the rinse tank which floods the rinse tank when the stop signal is received to cover the steel product with fluid, thus preventing corrosion and spray staining or air staining. With the delay system, the rinse control system delays controlling the actuator to close the cover and the pumping system from pumping fluid to the flood piping until a preset time has passed in case the line stop is only temporary and would not result in damage to the steel product or staining.

With the system and method, residue can be rinsed from the steel product at any line speed for feeding the steel product through the system, including a line stop where the steel product is no longer moving, without the danger of the steel product being damaged from corrosion or staining. Accordingly, the throughput of marketable steel product which is produced by this system and method is increased because the superior cleaning technique of spraying can be utilized at slow speeds without the risk of the steel product being damaged or stained during a line stop. A delay system may be included in the system and method to further increase the throughput of the system by waiting a preset period of time before initiating the flooding procedure of the rinse tanks in case the line stop is only temporary and the steel product is not in danger of being damaged or stained. Also additives can be added to this system to help in further delaying rinse staining if so desired.

DETAILED DESCRIPTION

Figure 1:
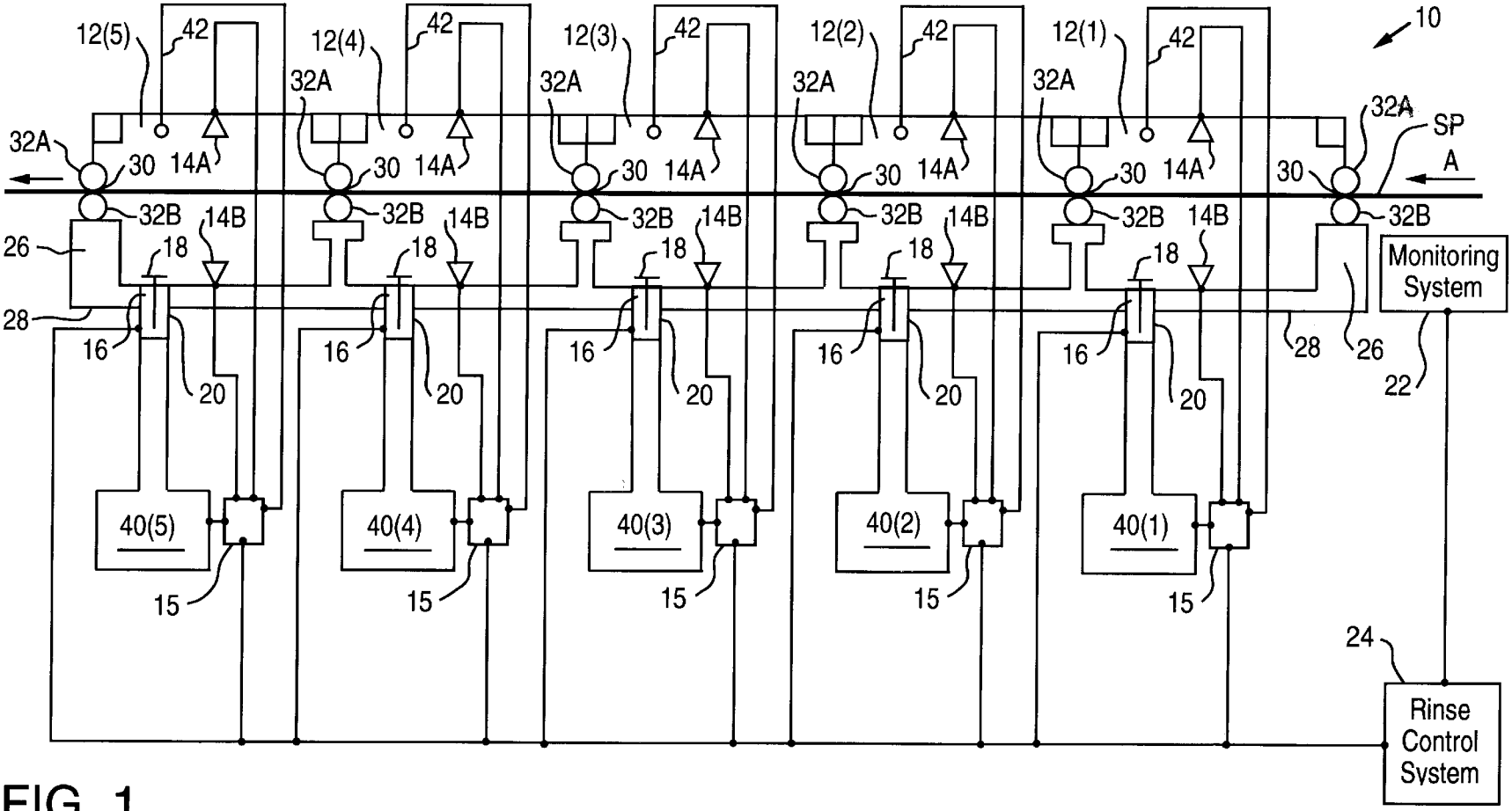
FIG. 1 is a block diagram of a system for rinsing residue from a steel product in accordance with the present invention.

A system 10 for rinsing residue from a steel product SP in accordance with the present invention is illustrated in FIG. 1. System 10 includes rinse tanks 12(1)–12(5), sprayer heads 14, pumping systems 15, drains 16 with drain covers 18, pneumatic actuators 20 for each drain cover, a monitoring system 22 for detecting movement of steel product SP and a rinse control system 24 for controlling the operation of the pumping systems 15, and pneumatic actuators 20. With system 10 and method, residue can be rinsed from steel product SP at any line speed for feeding steel product SP into system 10, including a line stop where steel product SP is no longer moving, without the danger of steel product SP being damaged from corrosion or stains.

Referring more specifically to FIG. 1, system 10 includes five rinse tanks 12(1)–12(5) which are connected in series. In this particular embodiment, rinse tank 12(1) holds 410 gallons of fluid in compartment 40(1), rinse tank 12(2) holds 632 gallons of fluid in compartment 40(2), rinse tank 12(3) holds 700 gallons of fluid in compartment 40(3), rinse tank 12(4) holds 767 gallons of fluid in compartment 40(4) and rinse tank 12(5) holds 1064 gallons of fluid in compartment 40(5), although the volume each rinse tank 12 can hold and the number of rinse tanks 12 used can vary as needed and desired. The holding tanks 40(1)–40(5) can be either a separate tank as shown in FIG. 1 or part of present rinse tanks 12(1)–12(5) as shown in FIG. 2.

Figure 2:
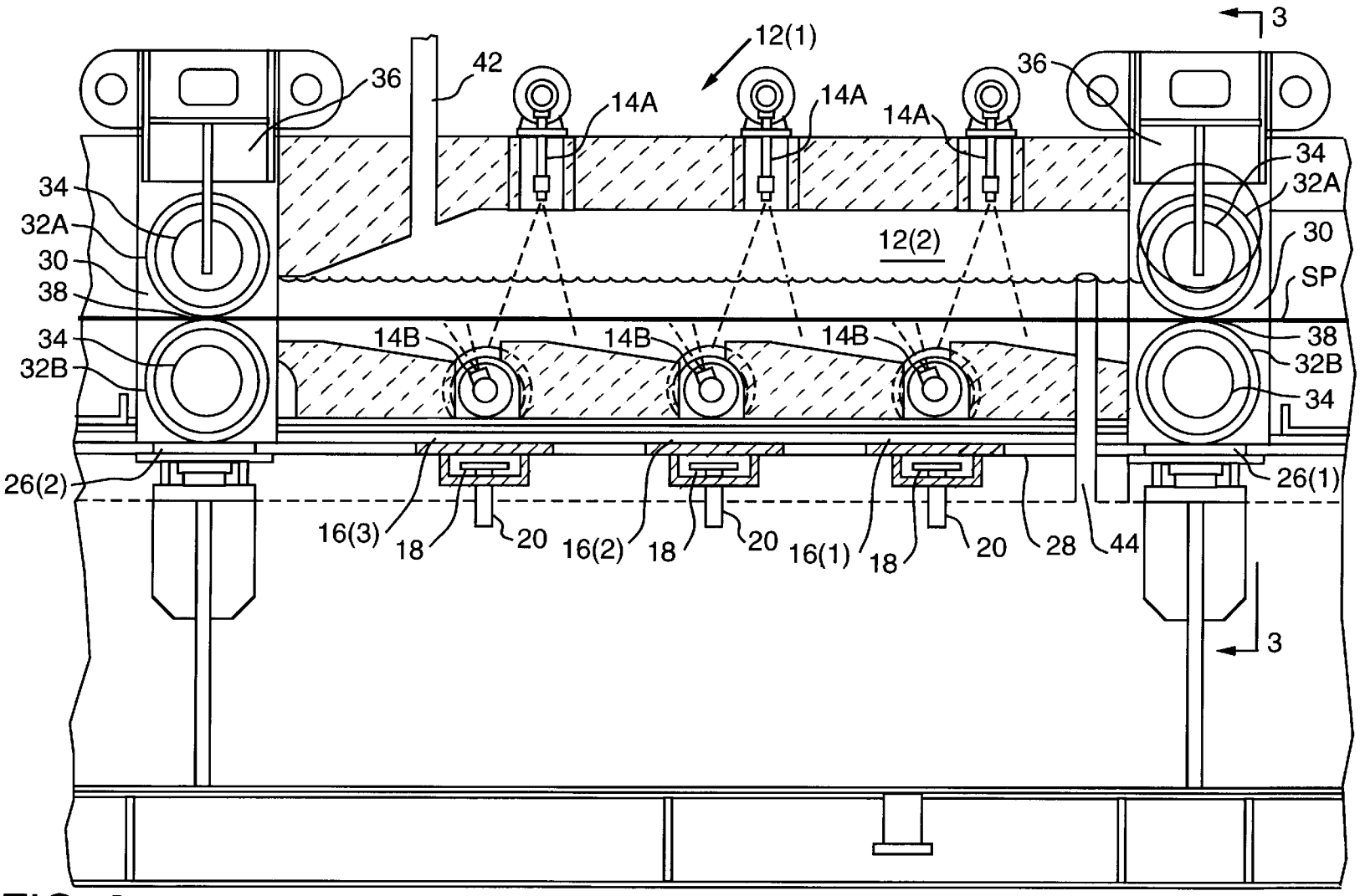
FIG. 2 is an enlarged view of one rinse tank in the system for rinsing residue from a steel product shown in FIG. 1.
Figure 3:
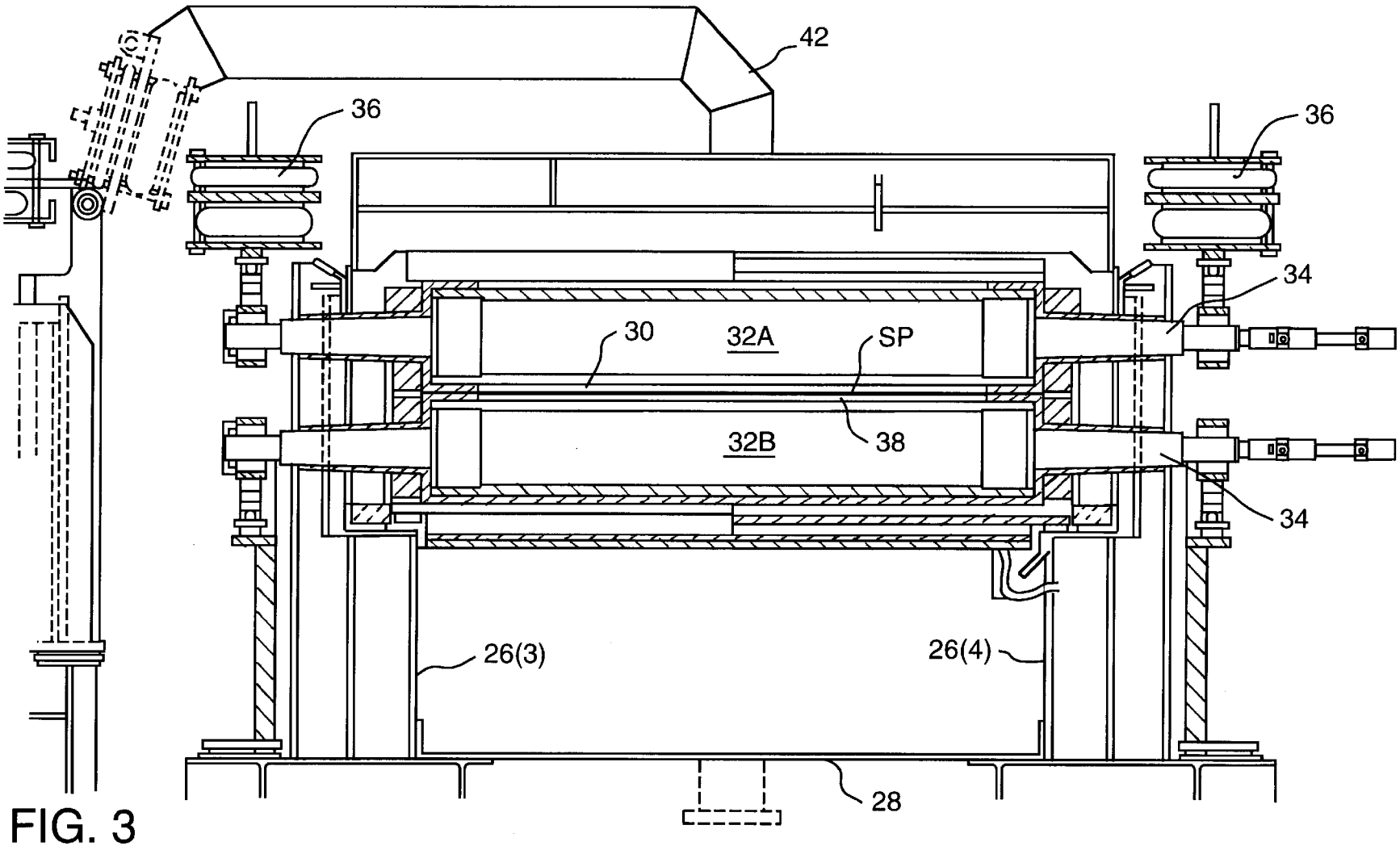
FIG. 3 is an end view taken along line 3—3 in FIG. 2 of the rinse tank with wringer rollers.

Referring to FIG. 2, one rinse tank 12(1) with holding tank 40(1) as part of rinse tank 12(1) is illustrated. Since the structure and operation of the other rinse tanks 12(2)–12(5)

are identical to rinse tank 12(1), except for the differences noted in this specification, the other rinse tanks 12(2)–12(5) will not be described in detail. Rinse tank 12(1) has side panels 26(1) and 26(2) and bottom panel 28 which define a tank interior. In this particular embodiment, each rinse tank 12 has a substantially rectangular shape with one bottom panel 28 and four side panels 26(1)–26(4) as shown in FIGS. 2 and 3, although each rinse tank 12 could have other shapes, such as circular, with other numbers of bottom and side panels. Each rinse tank 12 has a pair of passages 30, with each passage 30 disposed in side panel 26 between bottom panel 28 and the top of rinse tank 12. Referring to FIG. 3, passage 30 defines an opening in side panel 26 which is sufficiently large for steel product SP being processed to pass through. Referring back to FIG. 1, adjacent rinse tanks 12 share a common side panel 26 with a common passage 30. Steel product SP travels through rinse tanks 12 through passages 30 along a direction of travel indicated by the arrow A.

Referring to FIGS. 2 and 3, a pair of wringer rollers 32A and 32B is located in each passage 30 with the wringer rollers 32A and 32B disposed in a substantially vertical relationship. Each wringer roller 32 has a substantially cylindrical shape and is mounted on and rotates about a mandrel 34. One end of one mandrel 34 for wringer roller 32A is connected to a drive system (not shown) which rotates wringer roller 32A and moves steel product SP through passage 30. A height adjustment system 36 is connected to mandrel 34 for upper wringer roller 32A and can adjust the height of upper wringer roller 32A and the amount of separation between the upper and lower wringer rollers 32A and 32B. The upper wringer roller 32A may be raised during entry of steel product SP to define an opening 38 for steel product SP to pass through. Although not shown, height adjustment system 36 could also be connected to and move both upper and lower wringer rollers 32A and 32B with respect to each other or only move lower wringer roller 32B. In this particular embodiment, height adjustment system 36 is a pneumatic system which operates on an independent air supply different from that used for pneumatic actuator 20. Wringer rollers 32A and 32B are positioned to be below the level of fluid when rinse tanks 12 are flooded and provide a seal between the respective rinse tanks 12. Also the wringer rolls 32A and 32B provide a seal when spray system is being used. Although not shown, wringer rollers 32A and 32B can be replaced by a bottom granite skid cap and rubber wiper arrangement where the rubber wiper is disposed over the granite skid cap. Although in this particular embodiment, wringer rollers 32A and 32B are used to move steel product SP through rinse tanks 12, other types of transport systems, such as external pulling devices could be used. External devices known to those knowledgeable in the field, including pinch rolls and bridle rolls, could be used.

Drains 16 each with drain covers 18 are located in each rinse tank 12 in bottom panel 28. Pneumatic actuator 20 is coupled to each drain cover 18 and is capable of moving drain cover 18 between an open position and a closed position in response to an open signal or close signal from rinse control system 24. Although drain cover 18 is shown, any type of drain seal could be used. Pneumatic actuator 20 is constructed from acid resistant materials and is connected to an independent air supply (not shown). Although pneumatic actuator 20 is shown in this particular embodiment, any type of device which can open and close the drain cover 18 could be used, such as a solenoid device. Each drain 16 in rinse tank 12 is connected by piping to a collection tank 40(1)–40(5) for each rinse tank 12(1)–12(5) to allow fluid in rinse tank 12(1)–12(5) to pass down to collection tank 40(1)–40(5), as shown in FIG. 1. For ease of illustration, only one drain 16 is shown in FIG. 1 although as shown in FIG. 2 each rinse tank 12 in this particular embodiment has three drains 16(1)–16(3). The number of drains 16 can vary as needed and desired. Although a separate collection tank 40(1)–40(5) is shown for each rinse tank 12(1)–12(5), the collection tank 40 can be part of the rinse tank 12(1)–12(5) as shown in FIG. 2.

Referring to FIGS. 1 and 2, sprayer heads 14A and 14B are located above and below the line of travel for steel product SP through each rinse tank 12(1)–12(5). In this particular embodiment, each rinse tank 12 has three upper sprayer heads 14A located over the line of travel for the steel product SP and three lower sprayer heads 14B located below the line of travel for steel product SP. Additionally, in this particular embodiment, each upper sprayer head 14A has seven sprayer nozzles, which each output 4.28 gallons per minute (GPM) of fluid at 20.8 pounds per square inch (PSI), and each lower spray head 14B has fourteen nozzles, which output 2.14 GPM of fluid at 20.8 PSI. Sprayer nozzles in each sprayer head 14A and 14B direct fluid, such as water, at a pressure sufficient to dislodge residue, such as pickling acid, which is still adhering to steel product SP. Although three upper and lower sprayer heads 14A and 14B are shown the number of sprayer heads 14A and 14B and the number of sprayer nozzles on each sprayer head 14A and 14B and the angle of spray can vary as needed and desired. Although not shown, sprayer heads 14A and 14B could be disposed only above or below the line of travel for steel product SP. In this particular embodiment, drains 16 are located beneath lower sprayer heads 14B.

A flooding pipe 42 is located in each rinse tank 12 and directs fluid into each rinse tank 12 to flood each rinse tank 12 during a line stop to prevent steel product SP from suffering any damage due to corrosion spray stains or air stains. In this particular embodiment, flooding pipe 42 outputs between 180 to 1000 GPM, although the volume of discharge and the number of flooding pipes 42 in each rinse tank 12 can vary as needed and desired.

Referring to FIG. 1, a pumping system 15 is connected by piping between each sprayer head 14A and 14B and flooding pipe 42 in each rinse tank 12 and each collection tank 40. Pumping system 15 may also be connected to an independent water supply (not shown), such as the local city water supply. Pumping system 15 controls when fluid is pumped from collection tank 40 and/or the independent water supply to sprayer heads 14A and 14B and/or to flooding pipe 42 in response to a spray signal and a flood signal from rinse control system 24. Pumping system 15 includes a valve (not shown) which directs the flow of fluid either to sprayer heads 14A and 14B or flooding pipe 42. During a line run when steel product SP is moving, pumping system 15 pumps fluid to sprayer heads 14A and 14B at high pressure and low volume. During a line stop when steel product SP is not moving, pumping system 15 pumps fluid to flooding pipe 42 at low pressure and high volume. Although in this particular embodiment, pumping system 15 either diverts fluid to sprayer heads 14A and 14B or flooding pipe 42, pumping system 15 can be designed to have separate control over the flow of fluid to sprayer heads 14A and 14B and flooding pipe 42 so that simultaneous flow to both is possible.

Referring to FIG. 2, an optional adjustable overflow 44 is located in each rinse tank 12 with one end of adjustable overflow 44 connected to a drain (not shown) which is connected to collection tank 40 with the other end positioned at the desired level of fluid in each rinse tank 12. The top of adjustable overflow 44 is above the line of travel of steel product SP through each rinse tank 12 and the height can be adjusted as needed and desired. When the fluid level in rinse tank 12 exceeds the height of adjustable overflow 44, then the fluid in rinse tank 12 flows into adjustable overflow 44 and then down the drain to collection tank 40.

Monitoring system 22 is positioned adjacent to rinse tank 12(1) in the system 10 and is designed to monitor the movement of steel product SP. When steel product SP is moving, monitoring system 22 outputs a run signal to rinse control system 24 and when the steel product SP has stopped, monitoring system outputs a stop signal to rinse control system 24. Although monitoring system 22 is located at the entrance of system 10, monitoring system 22 could be positioned anywhere throughout system 10 to monitor movement of steel product SP through rinse tanks 12.

Rinse control system 24 is coupled to monitoring system 22, pumping systems 15, and pneumatic actuators 20. Rinse control system 24 sends a spray signal to pumping systems 15 to divert fluid at high pressure and low volume to sprayer heads 14A to spray fluid on steel product SP and an open signal to pneumatic actuators 20 to keep drain covers 18 open when steel product is moving through rinse tanks 12 and sends a flood signal to pumping system 15 to divert fluid at low pressure and high volume to flooding pipes 42 to flood rinse tanks 12 and a close signal to pneumatic actuators 20 to close drain covers 18 when steel product SP stops moving. Rinse control system may include a delay system which is designed to make rinse control system 24 wait a preset period of time, in this particular embodiment between zero and sixty seconds, before closing drain covers 18 and diverting the flow of fluid to flooding pipes 42. The delay is useful during temporary line stoppages which do not require flooding of rinse tanks 12 because steel product SP would not be damaged or stained during the line stop, thus increasing the throughput of system 10.

System 10 and method operate to rinse residue, such as pickling acid and dissolved oxide scale, from a steel product SP, such as steel strip, with a fluid, such as water. Steel product SP passes monitoring system 22 which senses for movement of steel product SP. If steel product SP is moving, then monitoring system 22 generates and outputs a run signal to rinse control system 24. If steel product SP is not moving, then monitoring system 22 generates and outputs a stop signal to rinse control system 24.

As steel product SP approaches passage 30 at first rinse tank 12(1), height adjustment system 36 raises upper wringer roller 32A to provide an opening 38 or space between upper and lower wringer rollers 32A and 32B for steel product SP to enter rinse tank 12(1). Upper wringer roller 32A is only moved enough to permit steel product SP to pass through. Once steel product SP is between upper and lower wringer rollers 32A and 32B, upper wringer roller 32A is brought down to rest on steel product SP creating a seal at that point. Upper wringer roller 32A is connected to the drive system (not shown) which rotates upper wringer roller 32A and drives steel product through rinse tanks 12. As steel product SP approaches each passage 30, upper wringer roller 32A is raised with respect to lower wringer roller 32B to permit steel product SP to pass through.

Steel product SP passes along a line between upper and lower sprayer heads 14A and 14B. When monitoring system 22 detects movement of steel product SP and outputs the run signal to rinse control system 24, then rinse control system 24 sends a spray signal pumping systems 15 to pump fluid at high pressure and low volume to sprayer heads 14A and 14B and to pneumatic actuators 20 to move drain covers 18 to an open position. Pumping systems 15 with sprayer heads 14A and 14B spray out fluid, such as water, onto steel product SP with sufficient force to dislodge any residue, such as pickling acid or dissolved scale, on steel product SP. In this particular embodiment, the fluid is sprayed on at 20.8 PSI although the particular pressure for the spray can vary as needed and desired. The fluid pumped out by pumping systems 15 to sprayer heads 14A and 14B in rinse tanks 12 comes from collection tanks 40 and/or an independent water supply, such as a city water line. The fluid sprayed on steel product SP falls down into rinse tank 12 and goes down drain 16 to collection tank 40 below rinse tank 12 as shown in FIG. 1 or to compartment tank 40 directly under and part of rinse tank 12 as shown in FIG. 2.

When monitoring system 22 detects that steel product SP is no longer moving, monitoring system 22 generates and outputs the stop signal to rinse control system 24. When rinse control system 24 receives the stop signal, then rinse control system 24 sends a close signal to pneumatic actuators 20 to move drain covers 18 to a closed position. Rinse control system 24 may also send a flood signal to pumping systems 15 to divert fluid flow to flooding pipes 42 to flood at low pressure and high volume rinse tanks 12. Flooding pipes 42 output fluid into rinse tanks 12 which floods rinse tanks 12 and covers steel product SP in rinse tanks 42 before any staining or corrosion can occur. In this particular embodiment, flooding pipes 42 fill each rinse tank 12 at a rate of between 180 to 1000 GPM. The height at which each rinse tank 12 is flooded is controlled by adjustable overflow 44. The top of each adjustable overflow 44 is positioned above the line of travel of steel product SP through rinse tanks 12. When the level of fluid in rinse tank 12 reaches the height of the top of the adjustable overflow 44 in a rinse tank 12, the fluid enters adjustable overflow 44 and drains down into collection tank 40. The top level of each adjustable overflow 44 can be adjusted as necessary and desired. Although in this particular embodiment, sprayer heads 14A and 14B are shut off when flooding pipes 42 are flooding rinse tanks 12, sprayer heads 14A and 14B could be left on. Since the rate at which each rinse tank 12 is flooded is substantially the same, there is little chance of fluid in one rinse tank 12 intermixing of fluid with another adjacent rinse tank 12.

Before sending the close signal pneumatic actuators 20 to move drain covers 18 to a closed position, rinse control system 24 may wait a preset period of time after receiving the stop signal before signalling pneumatic actuators 20 and pumping systems 15. In this particular embodiment, the preset period of time is between zero and sixty seconds. If rinse control system 24 did not delay before sending the close signal to pneumatic actuators 20 and the flood signal pumping system 15, then upon any line stop pumping systems 15 with flooding pipes 42 would flood rinse tanks 12. Once flooding has occurred in each rinse tank 12, drainage of rinse tank 12 must occur before further processing can be performed which is time consuming and reduces throughput. However, since some line stops are for such a short period of time that flooding is unnecessary (because the line stop is not sufficient long enough to allow corrosion or staining to occur), the delay system is included. The delay provides an opportunity for system 10 to be restarted during one of these temporary line stops without initiating flooding so that production of steel product SP can be resumed more quickly increasing the throughput of system 10.

Once monitoring system 22 detects movement of steel product SP, monitoring system 22 again transmits a run signal to rinse control system 24 which transmits an open signal to pneumatic actuators 20 to open drains 16 in rinse tanks 12 and the spray signal to pumping systems 15 to shut off fluid flow to flooding pipes 42 and to pump fluid at high pressure and low volume to sprayer heads 14A and 14B. The fluid in rinse tanks 12 passes through drains 16 to collection tanks 40 below each rinse tank 12 for further use. The above cycle is repeated throughout the operation of system 10.

Accordingly, with the system and method, residue can be rinsed from the steel product at any line speed for feeding steel product into the system, without the danger of steel product being damaged from corrosion or stain during a line stop because flooding of the rinse tanks is triggered. As a result, the throughput of marketable steel is increased. System may include a delay system which further increases the throughput of system because flooding is only triggered for stoppages of the steel product for greater then a preset period of time.

Having thus described the basic concept of the invention, it will be readily apparent to those skilled in the art that the foregoing detailed disclosure is intended to be presented by way of example only, and is not limiting. Various alterations, improvements and modifications will occur and are intended to those skilled in the art, but not expressly stated herein. These modification, alterations and improvements are intended to be suggested hereby, and within the spirit and scope of the invention. Accordingly, the invention is limited only by the following claims and equivalents thereto.

What is claimed is:

1. A method for removing residue from a steel strip product with a fluid while the strip is moved through a treatment tank, and to minimize staining of the strip during periods when the strip is stopped, the method comprising the steps of:

spraying fluid onto the strip as it moves through the tank;

monitoring movement of the steel product through at least one rinse tank and generating a run signal when the steel product is moving and a stop signal when the steel product has stopped moving; and controlling a pumping system to pump fluid to at least one sprayer in the rinse tank and an actuator to open a drain seal in a drain in the rinse tank when the run signal is received and to control the actuator to close the drain seal to accumulate a predetermined level of fluid in the tank when the stop signal is received.

2. The method as set forth in claim 1 wherein the step of controlling further comprises controlling the pumping system to pump fluid to a flooding pipe in the rinse tank when the stop signal is received.

3. The method as set forth in claim 1 further comprising the step of delaying the actuator from closing the cover and the pumping system from pumping fluid to the flooding pipe until a preset time has passed.

4. The method as set forth in claim 3 further wherein the preset time is between zero and sixty seconds.

5. The method as set forth in claim 1 further comprising a means for adjusting the level of the fluid in the rinse tank.

6. The method as set forth in claim 5 wherein the means for adjusting comprises an adjustable overflow pipe.

7. The method as set forth in claim 1 wherein the actuator is a pneumatic actuator.

8. The method as set forth in claim 1 wherein the sprayer comprises at least one sprayer head positioned above the steel product.

9. The method as set forth in claim 8 wherein the sprayer further comprises at least one sprayer head positioned below the steel product.

10. In a system for rinsing residue from steel strip with a fluid, including at least one rinse tank, at least one sprayer within the tank for directing rinse fluid onto the surface of the strip, means for pumping the rinse fluid to the sprayer, drain means having open and closed positions for selectively draining or accumulating rinse fluid in the tank, and means for moving the strip through the tank, the improvement comprising, a monitoring system for monitoring movement of the strip through the tank and generating a stop signal when the strip has stopped moving and a run signal when the strip is moving; and a controller operatively connected to the pump means, the drain means and the monitoring system to pump fluid to the sprayer and open the drain means when a run signal is received and to pump fluid and close the drain means to accumulate a predetermined level of fluid in the tank when a stop signal is received whereby staining of the strip is minimized during periods when the strip is stopped.

11. The system as defined in claim 10 including a flooding pipe in the tank connected to the pump means for flooding the strip in the tank in a predetermined period of time after a stop signal is received.

12. The system as defined in claim 11 including a delay means to prevent closing the drain means and flooding the strip until a preset time has passed following receipt of a stop signal.

13. The system as set forth in claim 12 further wherein the preset time is between zero and sixty seconds.

14. The system as set forth in claim 10 further comprising an adjusting device for adjusting the level of the fluid in the rinse tank.

15. The system as set forth in claim 14 wherein device for adjusting comprises an adjustable overflow pipe.

16. The system as set forth in claim 10 wherein the drain means includes a pneumatic actuator.

17. The system as set forth in claim 10 wherein the sprayer comprises at least one sprayer head positioned above the steel strip.

18. The system as set forth in claim 17 wherein the sprayer further comprises at least one sprayer head positioned below the steel strip.

* * * * *